United States Patent [19]

Neal, Jr.

[11] 4,227,695

[45] Oct. 14, 1980

[54] BATTLE OF THE ALAMO GAME

[76] Inventor: Charles M. Neal, Jr., 1145 Buschong, Houston, Tex. 77039

[21] Appl. No.: 5,582

[22] Filed: Jan. 22, 1979

[51] Int. Cl.[3] ..... A63F 3/00

[52] U.S. Cl. ..... 273/255; 273/249

[58] Field of Search ..... 273/255, 262, 249, 248, 273/250–254, 243

[56] References Cited

U.S. PATENT DOCUMENTS

| | | | |
|---|---|---|---|
| 1,642,711 | 9/1927 | Alfonso | 273/249 |
| 2,310,686 | 2/1943 | Freer | 273/255 |
| 3,787,056 | 1/1974 | Hellmann | 273/251 |

*Primary Examiner*—Richard C. Pinkham
*Assistant Examiner*—Scott L. Brown
*Attorney, Agent, or Firm*—Carl B. Fox, Jr.

[57] ABSTRACT

A game in which a game board is provided on which is depicted plural routes of attack against defenders of the Alamo. In the case of each attacker the game is played in three phases of play. The chances of the defender in defense of the Alamo are different for each of the three phases of play. An attacker must progress through the siege phase and through the assault phase before attaining the last stand phase. Each route of attack against the Alamo consists of a series of squares along which an attacker moves, certain of the squares bearing indicia indicating a procedure or happening to which the attacker may be subjected. The defender and each attacker is initially supplied with a plurality of markers each representing a person or soldier. Advances of the attackers are controlled by throws of dice, and loss of persons or soldiers in each defending and attacking force is controlled by throws of dice.

4 Claims, 2 Drawing Figures

BATTLE OF THE ALAMO GAME

BRIEF SUMMARY OF THE INVENTION

The invention comprises a game, called the Battle of the Alamo Game, which is played on a game board bearing a depiction of the Alamo and attack routes for attack of the Alamo. The Alamo is defended by a force of men, indicated by markers, and each attacking army is similarly represented by a force of men represented by markers. Each attacking army is represented by a special marker which is moved along an attack route according to throws of dice as the game progresses. Each attacking army or force moves through three phases, namely, a siege phase, an assault phase, and a last stand phase. The defense of the Alamo is the responsibility of one player, and other players, one to three in number, each have an army or force of men for use in an attack against the Alamo. The manner of play for each of the three game phases is different. When battles occur during play of the game, the depletion or non-depletion of the defending force and each attacking force is determined according to throws of dice and by procedures indicated on spaces on the board. During each battle, the defender and attacker each throw dice, the throws of the defender and attacker being compared to determine the result of the battle. For each phase of an attack, the odds for success of defense of the Alamo are different.

A principal object of the invention is to provide a game apparatus and manner of play or method for play of the game to simulate defense of an attack against the historic Texas shrine, the Alamo. Another object of the invention is to provide such a game apparatus and method for play wherein attack against the Alamo occurs in plural phases. A further object of the invention is to provide such a game apparatus and method for play, the play of which is determined by throws of dice the manner of use of which is affected by the phase of attack in which an attacker is at that time positioned. Yet another object of the invention is to provide such game apparatus and method for play which is adapted for play by players of a wide diversity of ages and which may be played by any number of players from two players to four players. A further object of the invention is to provide such game apparatus and methods for play which are exciting and fun.

Other objects and advantages of the invention will appear from the following detailed description of preferred embodiments of apparatus and method according thereto, reference being made to the accompanying drawings.

BRIEF DESCRIPTIONS OF THE DRAWINGS

DETAILED DESCRIPTION OF THE PREFERRED EMBODIMENT

Figure 1:
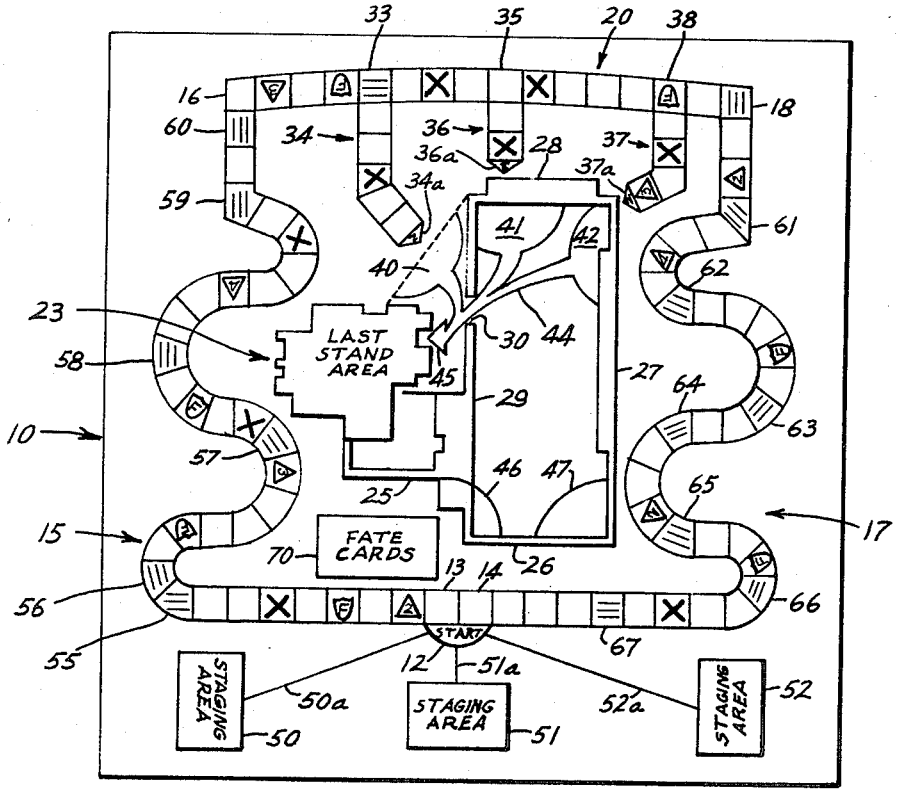
FIG. 1 is a top view of a game board of preferred form according to the invention.
Figure 2:
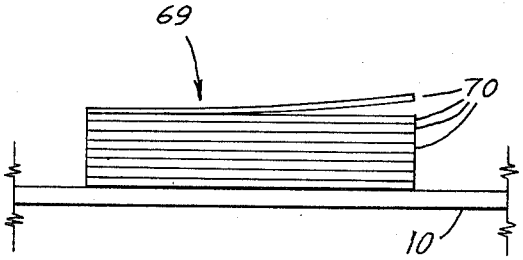
FIG. 2 is a side elevation showing a stack of cards employed during play of the game, and forming part of the apparatus.

Referring to the drawings in detail, and first to FIG. 1, there is shown a game board 10 which may be of square or rectangular flat sheet form. Preferably, the game board will consist of one or more pieces of heavy paper or cardboard to one side of which a paper sheet bearing a pictorial depiction of the game is affixed by gluing or cementing. Board 10 may, as is customary, be formed of two pieces of cardboard of the same size which are joined by a hinge strip, this form not being shown but being so common in the art as to not require further description. The hinged half-portion construction of the game board enables folding to reduce the size of the game board for storage.

The depiction of the game on board 10 includes a semi-circular area 12 disposed against a side of a pair of spaces 13, 14 marked by boundary lines. From initial space 13, a series of adjoining outlined spaces form a printed pathway 15 extending through straight and curved portions to corner space 16. From initial space 14, a series of adjoining outlined spaces form a pathway 17 extending through straight and curved portions to corner space 18. A slightly curved line of adjoining outlined spaces 20 connect between corner spaces 16 and 18. The Alamo, to be defended, is indicated by reference numeral 23. Walls and battlements 25–29 outline a walled-in area adjacent the Alamo. Wall 29 has a gateway 30 therethrough. From space 33 of series of spaces 20, a series of spaces 34 is directed toward the Alamo. From space 35, a series of spaces 36 is similarly directed. A third series of spaces 37 leads from space 38 of series of spaces 20. Series of spaces 34 and 37 are angular, as shown, while series of spaces 36 is shorter and straight. Areas 40–42 are connected by merged arrows 44 leading to arrowhead 45 directed toward the Alamo building. Additional areas 46, 47 are also illustrated on board 10. Spaces 34, 36 and 37 terminate in triangular areas **34*a*, 35*a* and 37*a* which are the locations of the attacking armies during the assault phase of the game. The arrow 45** is the last stand position of an attacker.

The areas 50, 51, 52 are for storage of the markers of each attacking player which represent the attacking personnel of his force. These areas are connected by lines **50*a*, 51*a*, and 52*a* to the start area 12. Each area 50, 51, 52 bears the word "STAGING AREA", and semi-circular space 12** bears the word "START".

The outlined spaces forming parts of the pathways 15, 17, and 20, which are indicated by reference numerals 55 through 67, 33 and 18 have words printed therein, as follows:

Space 55—Ambush! Lose 10 men
56—Disease kills 10 men
57—Retreat 5 spaces back
58—Snipers kill 10 men
59—Cannon fire kills 20 men
60—Ambush! Lose 15 men
33—Disease kills 9 men
18—Charge ahead 2 spaces
61—Desertion! Lose 7 men
62—Ambush! Lose 10 men
63—Disease kills 15 men
64—Retreat 8 spaces
65—Ambush! Lose 7 men
66—Texan volly kills 20
67—Desertion! Lose 5 men In FIG. 1, squares indicated by an "X" each bears a cross having a number designation at its center. These are not shown on the drawings because of space limitations. The cross symbol is an "artillery duel" symbol, the purpose of which will be later explained. Certain spaces bear a shield outline having the word "FATE" therewithin, the word "FATE" being indicated by the letter "F" in the drawing. A third symbol which appears in certain of the spaces is a black arrow point or triangle containing a number therewithin, this symbol designating a close range gun fight or "fire fight".

A stack or deck 69 of twelve FATE cards 70 is disposed within space 70 shown in FIG. 1. Whenever an attacking player arrives upon a space bearing a shield and the word "FATE", that attacking player draws a FATE card from the top of the stack. The instructions written on the underside of the FATE card are followed, after which the FATE card is returned to the bottom of the stack of FATE cards. The twelve FATE cards respectively bear the following inscriptions:

"ONE OF YOUR CANNONS EXPLODES ACCIDENTALLY. YOU WILL LOSE 8 MEN."

"YOU ARE SUCCESSFUL IN A SNEAK ATTACK. ADVANCE 4 ADDITIONAL SPACES."

"CHARGE AHEAD FOUR SPACES."

"HEAVY ARTILLERY BARRAGE BY TEXANS. YOU LOSE FIVE MEN. THE REST OF YOUR MEN PANIC AND RETREAT. GO BACK TEN SPACES. (RETURN TO START SPACE IF YOU HAVE NOT ADVANCED TEN SPACES)."

"YOUR CALVARY HORSES STAMPEDE. GO BACK SIX SPACES."

"YOUR MEN ARE TIRED AND HUNGRY. THEY NEED AMMUNITION AND FOOD. RETURN TO THE START AREA."

"NIGHT ATTACK. YOUR TROOPS KILL FIVE TEXANS"

"YOUR MEN GET CAUGHT IN A TEXAS CROSS FIRE. LOSE SEVEN OF YOUR MEN."

"YOUR MEN EAT SOME BAD TAMALES. LOSE TWO TURNS."

"ONE OF YOUR TROOP WAGONS OVERTURNS. YOU LOSE FIVE MEN."

"MEXICAN ARTILLERY BARRAGE KILLS TEN TEXANS."

"GUARDS ARE NOT ON THE ALERT AND 35 ADDITIONAL TEXANS ARRIVE TO REINFORCE THE ALAMO GARRISON. PLACE THE 35 ADDITIONAL BLUE CUBES INSIDE THE ALAMO."

Preparation for beginning play of the game requires selection by each attacker of his choice of cubemarkers representing men and a single figurine marker for use along the play paths of the board. The FATE cards are shuffled and placed face down in the designated space on the board. The cube markers of each attacking player are placed in one of the spaces identified by the words "STAGING AREA". For distinguishing between the markers of the different attackers, the markers of each are a different color.

If there is more than one attacking player, each attacking player rolls two dice and the attacking player receiving the highest point count on the dice plays first. In case of a tie, the dice are rolled again. Each attacking player places his cube markers representing men in a container within the "STAGING AREA" space identified by the color of his movement figurine. The Alamo defender may place his cubes in any disposition within the Alamo compound that he chooses, this disposition of the defender's cubes not being of any real significance to the play of the game, but lending excitement because of the diversity of arrangements which different players may achieve.

With respect to each attacking player, the initial play is in the Siege Phase of the game. The attacking player places his figurine in the start space, and in turn rolls one die while the Alamo defender rolls three dice. An attacker may move out from the start space in either direction, either through space 13 or through space 14. Once he chooses his direction of play, he may not change it, unless required to do so by space or fate card instructions. The Alamo defender rolls his three dice each time an attacker rolls his single die. Whenever the defender rolls doubles, the attacker rolling against him must remove two cubes from his staging area. In the event the defender rolls triples, the attacker must remove three cube markers. Other than in these instances, the defender's roll of the dice has no effect upon this phase of the game unless the attacker should land in a space indicated by an arrow tip or a cross. As each attacker moves along the spaces, he will be instructed to remove a specific number of cubes whenever he lands upon a "hazard" block. The losses resulting from "hazard" blocks will be in addition to other losses incurred as a result of the defender rolling doubles or triples. Whenever an attacker lands on a space marked by a shield bearing the word "FATE", he draws the top card from the stack of "FATE" cards and follows the instructions on the reverse or underside of the FATE card. The card drawn is thereafter placed at the bottom of the stack of FATE cards. Whenever an attacking player lands on a space indicated by a black arrow point containing a number within its center, the attacker must then play a close range gun fight or "fire fight". In a fire fight, the attacker and defender each throw two dice, each player totaling up the count of his two dice. The player having the largest total is the victor in the fire fight, and the defeated player must remove the number of cubes indicated by the difference between the count of his dice and the count of the victor's dice. This process is repeated as many times as is indicated by the number on that particular fire fight symbol.

Whenever an attacking player lands on a space marked by a cross with a number at its center, the Alamo defender rolls two dice and removes the number of cubes from the attacker's container as is indicated by the total count of his two dice. This process is repeated as many times as is indicated by the number on the artillery dual symbol. As will be apparent, the Alamo defender receives a very distinct advantage whenever an attacking player lands on an artillery dual cross symbol.

Once the attacker has moved along the spaces to an assault arrow head 34*a*, 36*a* or 37*a*, the assault phase commences with regard to that attacker. At this point, the Alamo defender may move as many of his cubes into the suitable defensive parts circled area opposite the attacker as he may desire. This movement of pieces simulates a genuine battle and adds emphasis to the game. In the assault phase, the attacker uses the number of dice as is indicated by the number in the assault phase arrow head upon which he has become positioned. Part of the strategy of the game is for an attacker to attempt to attain the assault point wherein he may use the greatest number of dice in his assault. The attacker rolls the number of dice indicated by his assault phase arrow head, and the defender rolls four dice. If the Alamo defender's highest die is equal to or greater than the highest die thrown by the attacker, then the attacker must remove one of his cubes. If the attacker's highest die is greater than the defender's highest die, the defender removes one of his markers. The second and third highest dice of both attacker and defender are compared in the same manner and the appropriate cubes are removed. Each attacker may make a maximum of five consecutive challenges, using the number of dice indicated by his assault phase arrow head, after which the next attacker plays his turn. An attacker at an assault point must challenge the defender and may not pass. The game continues in this phase with regard to any or all attackers who have arrived at the assault phase until the Alamo defender has no more than twenty cube markers remaining. At that point, the Alamo defender moves all twenty or less of his cube markers to the last stand area, the Alamo building itself.

In the last stand phase, any attacker who has arrived at an assault point moves his figurine to the gray arrow point at the doorway of the Alamo, the last stand area. In the last stand area, the method of challenging with the dice is changed somewhat from that at the assault phase, and the number of dice allowed for each player is changed. The defender uses two dice to one die for the attacker. The dice are rolled and compared as in the assault phase, and a cube of the losing player is removed. As in the assault phase, a tie goes to the benefit of the Alamo defender. Play continues in this fashion until all of the defenders cube markers are removed or until all of the attackers cube markers are removed. The player having one or more cube members remaining at the end of the game is the winner.

To add color and attractiveness to the game board, the successive spaces are preferably of different colors. All of the spaces marked by arrow points are preferably of the same color, all of the spaces marked by artillery dual cross symbols are of another color, and all of the fate spaces marked by a shield bearing the word FATE are of still another color. The colors of the other spaces are arranged to effectively decorate the game board and to make distinction between adjacent spaces simple. Each attacker staging area and play figurine are preferably of the same color, the colors of the individual attackers preferably being different. The Alamo defender's cube markers are preferably of a color different from any attacker's color.

Play of the game involves a symbolic reinactment of the historic battle of the Alamo. An attacker's excitement grows as he moves from the siege stage through the assault phase to the last stand phase. This excitement is shared by the Alamo defender, since he must withstand the attack of each attacker.

While a preferred embodiment of the method and apparatus according to the invention have been described and shown in the drawings, many modifications thereof may be made by persons skilled in the art without departing from the spirit of the invention, and it is intended to protect by Letters Patent all forms of the invention falling within the scope of the following claims.

I claim:

1. Game, simulating the Battle of the Alamo, comprising a game board bearing a game pattern depicting the Alamo and routes of attack against the Alamo; said pattern including a start space spaced from one side of the Alamo, a series of side by side spaces extending in a path spacedly disposed around the Alamo and two adjacent spaces thereof having a common side with said start space, past which said path extends, plural branch paths each extending from said path toward the Alamo at the other side thereof from said start space and each comprising a plurality of side by side spaces the terminal one of which is spacedly adjacent the Alamo; said path providing two opposite attack routes from said start space to said branch paths one or the other of which is selected by each attacking player leaving said start space; said pattern including a walled courtyard area adjacent the Alamo toward which said branch paths are directed, and arrow means disposed across said courtyard area from adjacent the inner end of each said branch path and merging to a common arrowhead directed toward the Alamo; a first plurality of markers each representing an individual of a defending force for use by a defending player in defense of the Alamo; at least one additional plurality of markers each representing an individual of an attacking force and each said additional plurality of members being for use by an attacking player in attack of the Alamo; a separate distinctive marker for each said attacking player for use in movements from said start space and along said path and branch paths in attack of the Alamo in response to throws of one or more dice; and dice means for use by the defending and attacking players during play of the game.

2. The combination of claim 1, spaced ones of said spaces of said path bearing word directions for an attacking player, whose said distinctive marker lands thereon.

3. The combination of claim 1, spaced ones of said spaces of said path bearing indicia indicating special procedures for an attacking player landing thereon.

4. The combination of claim 3, including a stack of instruction bearing cards for disposition on said board, a card to be drawn therefrom by an attacking player landing on a space bearing certain of said indicia.

* * * * *